US011167255B2

(12) United States Patent
Hensley et al.

(10) Patent No.: US 11,167,255 B2
(45) Date of Patent: Nov. 9, 2021

(54) APPARATUS FOR MAKING A SOLUTION AND RELATED METHODS

(71) Applicant: Cargill, Incorporated, Wayzata, MN (US)

(72) Inventors: Anthony Quinn Hensley, Ringgold, GA (US); Bill Miller, Dubuque, IA (US); Chet Womack, Floyds Knobs, IN (US)

(73) Assignee: Cargill, Incorporated, Wayzata, MN (US)

( * ) Notice: Subject to any disclaimer, the term of this patent is extended or adjusted under 35 U.S.C. 154(b) by 344 days.

(21) Appl. No.: 15/736,068

(22) PCT Filed: Jun. 28, 2016

(86) PCT No.: PCT/US2016/039840
§ 371 (c)(1),
(2) Date: Dec. 13, 2017

(87) PCT Pub. No.: WO2017/004054
PCT Pub. Date: Jan. 5, 2017

(65) Prior Publication Data

US 2018/0178175 A1 Jun. 28, 2018

Related U.S. Application Data

(60) Provisional application No. 62/186,735, filed on Jun. 30, 2015.

(51) Int. Cl.
*B01F 5/10* (2006.01)
*B01F 5/02* (2006.01)
(Continued)

(52) U.S. Cl.
CPC ..... *B01F 5/10* (2013.01); *B01F 1/0027* (2013.01); *B01F 5/0206* (2013.01);
(Continued)

(58) Field of Classification Search
CPC ..... B01F 5/10; B01F 5/0206; B01F 1/0027; B01F 15/0022; B01F 15/0235; B01F 15/0277
(Continued)

(56) References Cited

U.S. PATENT DOCUMENTS 5,332,312 A 7/1994 Evanson
5,335,690 A 8/1994 Worth
(Continued)

FOREIGN PATENT DOCUMENTS

JP 2007519581 A 7/2007
JP 2009502482 A 1/2009
(Continued)

*Primary Examiner* — Marc C Howell

(57) ABSTRACT

The present disclosure includes methods of making a brine solution that include recirculating brine solution to a salt and water hopper from a holding tank. The present disclosure also includes an apparatus for making a solution that includes at least one nozzle assembly positioned inside the lower half of a hopper. The at least one nozzle assembly includes a manifold having at least two nozzles spaced apart. Each nozzle has one or more nozzle outlets that are directed away from the bottom of the hopper (e.g., toward the top of the hopper).

12 Claims, 4 Drawing Sheets

(51) Int. Cl.
*B01F 15/00* (2006.01)
*B01F 1/00* (2006.01)
*B01F 15/02* (2006.01)

(52) U.S. Cl.
CPC ..... *B01F 15/0022* (2013.01); *B01F 15/0235* (2013.01); *B01F 15/0277* (2013.01); *B01F 15/00844* (2013.01); *B01F 2215/008* (2013.01)

(58) Field of Classification Search
USPC ..... 366/134
See application file for complete search history.

(56) References Cited

U.S. PATENT DOCUMENTS

| | | | | |
|---|---|---|---|---|
| 5,368,385 | A | 11/1994 | Adamo | |
| 5,819,776 | A | 10/1998 | Kephart | |
| 6,439,252 | B1 | 8/2002 | Kephart | |
| 6,451,270 | B1 * | 9/2002 | Killian | B01F 1/0022 137/1 |
| 6,468,481 | B1 | 10/2002 | Anderson | |
| 6,736,153 | B1 | 5/2004 | Kime | |
| 7,186,390 | B1 | 3/2007 | Hellbusch | |
| 2003/0058735 | A1 | 3/2003 | Qureshi | |
| 2007/0025179 | A1 * | 2/2007 | Hildreth | B01F 1/0016 366/136 |
| 2010/0086445 | A1 | 4/2010 | Sims et al. | |
| 2012/0051982 | A1 | 3/2012 | Kois | |
| 2013/0099155 | A1 | 4/2013 | Nesheim | |
| 2013/0161268 | A1 | 6/2013 | Adams et al. | |

FOREIGN PATENT DOCUMENTS

| | | | |
|---|---|---|---|
| WO | 2003058735 | W | 7/2003 |
| WO | 2005073095 | W | 8/2005 |
| WO | 2013099155 | W | 7/2013 |
| WO | 20130099155 | W | 7/2013 |

* cited by examiner

APPARATUS FOR MAKING A SOLUTION AND RELATED METHODS

RELATED APPLICATIONS

This application is a national phase application of PCT/US2016/039840, filed Jun. 28, 2016 entitled APPARATUS FOR MAKING A SOLUTION, AND RELATED METHODS, which claims the benefit of priority to U.S. Provisional Pat. Application No. 62/186,735 filed Jun. 30, 2015, entitled APPARATUS FOR MAKING A SOLUTION, AND RELATED METHODS, which are hereby incorporated by reference in their entirety.

FIELD

The present disclosure involves apparatuses for making a solution (e.g., a brine solution), and related methods for making said solution.

BACKGROUND

Apparatuses for making solutions are known. See, e.g., U.S. Pat. No. 5,332,312 (Evanson); U.S. Pat. No. 5,335,690 (Worth); U.S. Pat. No. 5,419,355 (Brennan et al.); U.S. Pat. No. 5,819,776 (Kephart); U.S. Pat. No. 6,439,252 (Kephart); U.S. Pat. No. 6,451,270 (Killian et al.); U.S. Pat. No. 7,186,390 (Hellbusch et al.); and U.S. Pat. No. 8,870,444 (Hildreth).

SUMMARY

Embodiments of the present disclosure include an apparatus for making a solution, the apparatus includes:

(a) a hopper including:
  (i) at least one side wall;
  (ii) a bottom;
  (iii) a top;
  (iv) at least one overflow weir;
  (v) a first liquid inlet positioned within the at least one side wall; and
  (vi) at least one nozzle assembly positioned inside the lower half of the hopper and coupled to the first liquid inlet, wherein the at least one nozzle assembly includes a manifold having at least two nozzles spaced apart, wherein each nozzle has one or more nozzle outlets that are directed away from the bottom of the hopper and/or one or more nozzle outlets that are directed toward the bottom of the hopper;

(b) a liquid holding tank positioned proximal to the hopper so that liquid in the overflow weir can flow into the liquid holding tank, wherein the liquid holding tank includes:
  (i) at least one side wall;
  (ii) a bottom; and
  (iii) at least one liquid outlet positioned within the at least one side wall; and (c) a pump system physically coupled to the first liquid inlet positioned in the hopper and the at least one liquid outlet positioned in the liquid holding tank, wherein the pump system is configured to pump liquid from the liquid holding tank into the hopper.

Embodiments of the present disclosure also include a method of making a brine solution including:

(a) providing an amount of salt in a hopper;

(b) providing an amount of water in the hopper so that the water dissolves at least a portion of the salt to form a brine solution and fills the hopper to a level so that the brine solution can flow through a hopper overflow weir into a liquid holding tank positioned proximal to the hopper and fills the liquid holding tank, wherein the amount of water is provided from a source other than the holding tank;

(c) recirculating at least a portion of the brine solution through a recirculation line from the liquid holding tank into the hopper;

(d) determining a concentration value of the brine solution in the recirculation line; and (e) continuously recirculating at least a portion of the brine solution through the recirculation line via a pump system from the liquid holding tank into the hopper until a target concentration value of the brine solution in the recirculation is measured.

DETAILED DESCRIPTION

Figure 1A:
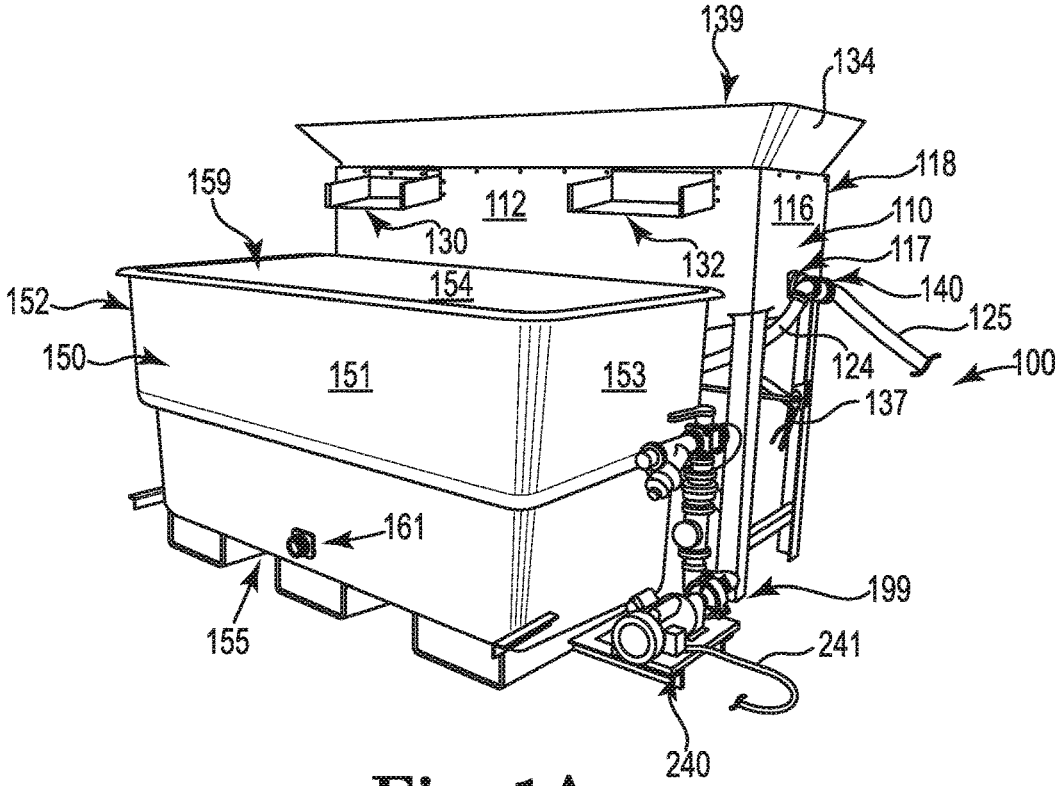
FIG. 1A shows a perspective view of an exemplary embodiment of an apparatus according to the present disclosure.

FIG. 1A shows an apparatus 100 for making a solution (e.g., a brine solution). Apparatus 100 includes a hopper 110, a liquid tank 150, and a pump system 199. As shown, hopper 110 has a rectangular-shaped footprint and is supported on four legs 111. As shown, hopper 110 includes a first side wall 112, a second side wall 114, a third side wall 116, a fourth side wall 118, a bottom 120, and an open top 139. The first side wall 112 is opposite the fourth side wall 118 and the first side wall 112 is adjacent to and between the second side wall 114 and the third side wall 116. As shown, a first liquid inlet 113 is positioned within the first side wall 112, a second liquid inlet 115 is positioned within the second side wall 114, and a third liquid inlet 117 is positioned within the third side wall 116. The second 115 and third 117 liquid inlets are in fluid communication with a source of water (not shown) that is independent from the apparatus 100. As shown, water line 125 is connected to the water source (not shown) and fitting 140 to feed inlet 117. Fitting 140 is also connected to hose 124 to feed inlet 115. Hopper 110 also includes overflow weirs 130 and 132 having openings that are rectangular in shape. Overflow weirs having a rectangular shape can allow the weirs to be positioned at a point in hopper 110 to permit a desired volume of hopper 110 to be utilized while providing a desired volumetric flow through the weirs. For example, the width of weirs 130 and 132 can be increased or decreased to change the volumetric flow without changing their vertical position in the hopper 110. Also, the number of such weirs could be increased or decreased as desired to change the volumetric flow. As shown, weirs 130 and 132 are positioned proximal to the top of hopper 110 so as to utilize as much of the hopper volume 110 as possible for mixing salt, water, and recirculated brine solution. Feed inlets 115 and 117 can have valves (e.g., shut off valves) and/or nozzles (not shown) as desired.

Figure 1C:
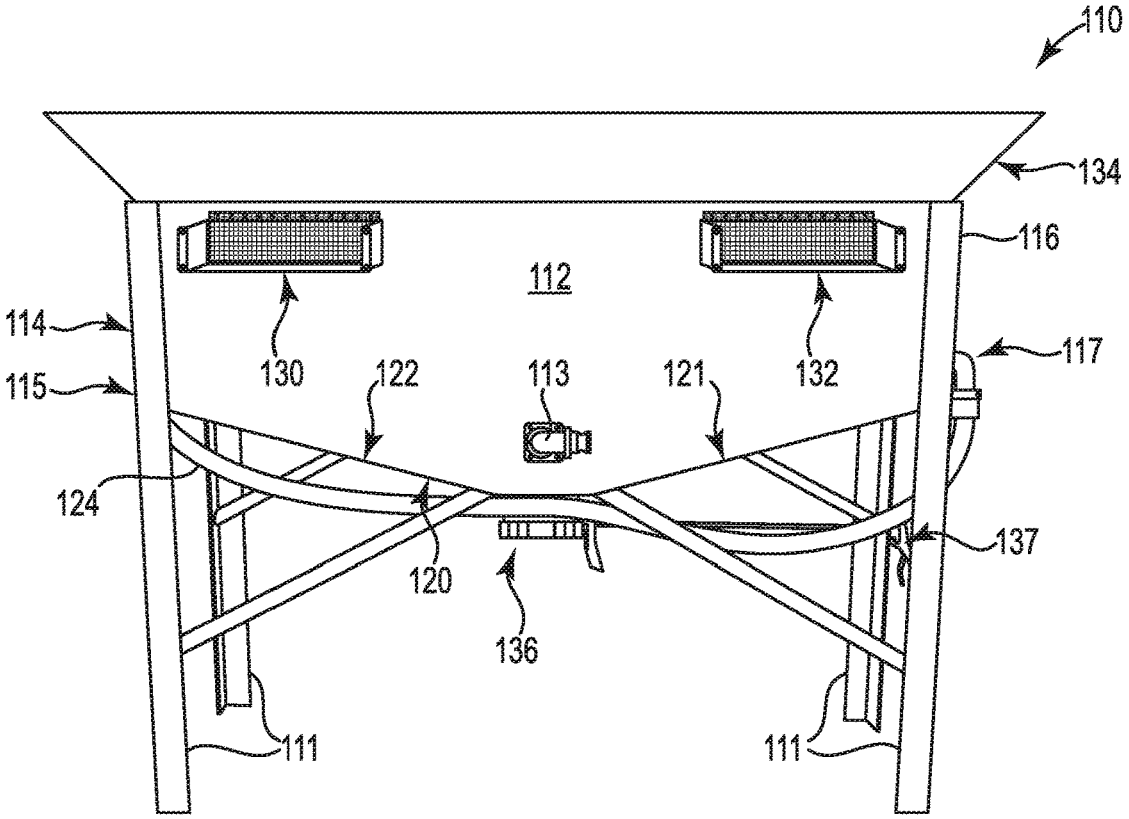
FIG. 1C shows the hopper of the apparatus shown in FIG. 1A with the liquid holding tank and pump system removed.

As shown in FIG. 1C, the bottom 120 of hopper 110 is angled downward from each of the side walls 114 and 116 toward the central portion of side walls 112 and 118. In more detail, the bottom 120 includes an angled bottom portion 121 and an angled bottom portion 122 that each end at the flat landing portion 123 in the middle of the bottom 120. As shown, the second 115 and third 117 liquid inlets are positioned in the second side wall 114 and third side wall 116, respectively, at a location above and proximal to bottom 120 so that the water source can be dispensed into tank 150 and flow down angled portions 122 and 121, respectively, to help clean out dirt and sludge (not shown) on the bottom 120 of hopper 110 and out of hopper 110 when cleanout valve 136 is open.

As shown, hopper 110 has an open top 139, which can receive a solute in solid form such as salt, e.g., from a front end loader (not shown).

Optionally, hopper 110 can include a spill deflector 134 that can help contain solid (solute) material that is loaded into hopper 110 such as salt and/or contain liquid material from splashing out of hopper 110 as additional solid material is loaded into hopper 110. As shown, spill deflector is made out of metal and is on three sides of hopper 110 so that there is there is easy access to hopper 110 from the back side (side wall 118) so that material such as salt can be loaded into hopper 110.

As shown in FIG. 1C, hopper 110 includes a cleanout valve 136 that can be controlled by cleanout handle 137.

Hopper 110 can be made out of a variety of materials such as fiberglass.

Figure 1B:
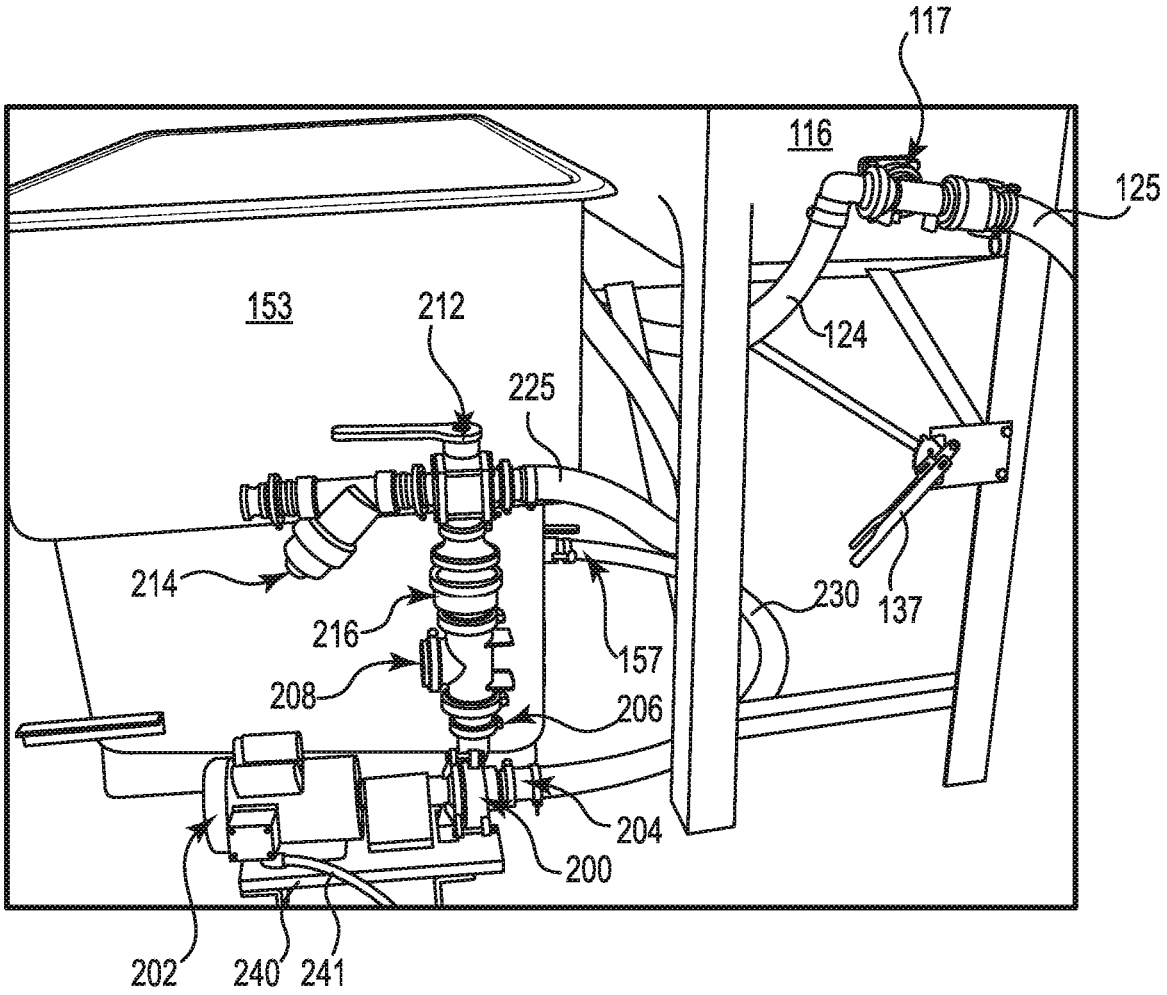
FIG. 1B shows a close up side view of the apparatus shown in FIG. 1A.
Figure 1D:
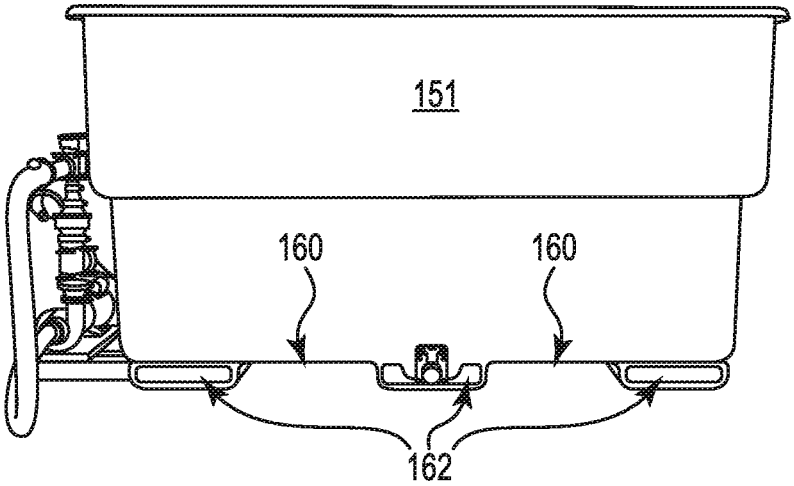
FIG. 1D shows a front view of the liquid holding tank of the apparatus shown in FIG. 1A with the hopper and pump system removed.
Figure 1E:
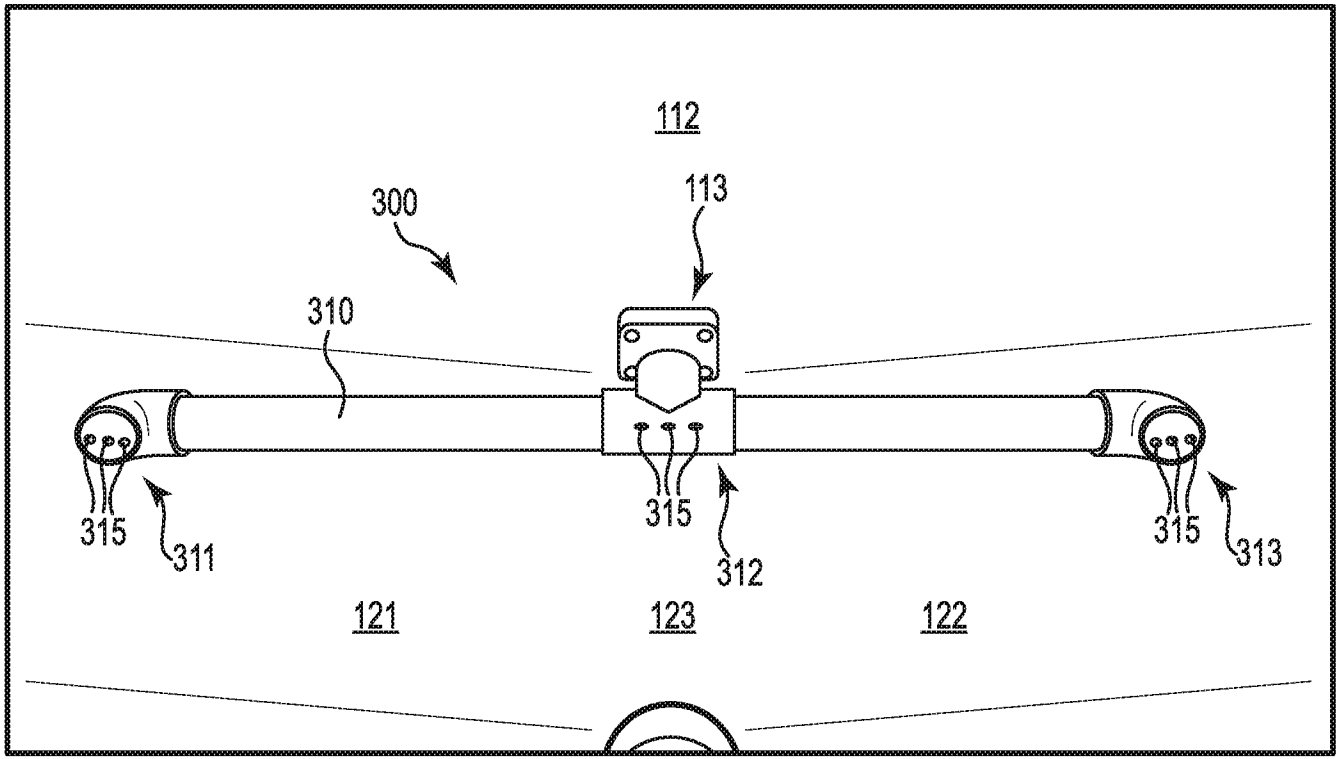
FIG. 1E shows an interior view of the hopper shown in FIG. 1A illustrating the centrally located nozzle assembly therein.

FIG. 1E shows a first interior view of a portion of the hopper 110 shown in FIG. 1A illustrating the nozzle assembly 300 positioned therein. Nozzle assembly 300 is coupled to the first liquid inlet 113. As shown, nozzle assembly 300 includes a manifold 310 (e.g., a linear tube) having a linear array of three nozzles 311, 312, and 313. As shown, each nozzle 311, 312, and 315 has multiple outlets 315. In some embodiments, each nozzle can be spaced at least 5 inches apart (e.g., in the range from 5 to 16 inches). As shown, nozzle 311 is spaced apart from nozzle 312 about 12 inches and nozzle 312 is spaced apart from nozzle 313 about 12 inches. Outlets 315 can be directed away from the bottom 120 of hopper 110. As shown, outlets 315 are directed (oriented) toward the top of hopper 110 so as to dispense recirculated brine solution toward the top of hopper 110 to help mix the solid salt and water as well as the brine that is recirculated from liquid holding tank 150. As shown, the nozzle assembly 300 is positioned proximal to the bottom 120 of the hopper 110 and is centrally located in the side wall 112. As shown, nozzle 311 is positioned proximal to angled bottom portion 121; nozzle 313 is positioned proximal to angled bottom portion 122; and nozzle 312 is positioned proximal to flat landing portion 123 in the middle of the bottom 120.

Alternatively, one or more outlets 315 could be angled toward the bottom 120 of hopper 110.

Optionally, in some embodiments, at least a portion of one or more interior surfaces of hopper 110 can include a coating and/or other materials to help protect the interior surfaces of the hopper 110 from undue wear. For example, the inside surface of one or more of the first side wall 112, the second side wall 114, the third side wall 116, the fourth side wall 118, and the bottom 120 can wear to an undue degree due to solid particles such as salt and/or dirt swirling around, especially due to the mixing action provided by nozzle assembly 300. Exemplary protective coatings include fluoropolymer coatings, epoxy coatings, and/or fluorinated propylene ethylene coatings. One or more interior surfaces of the hopper can be protected by attaching a wear plate such as a stainless steel plate (e.g., ⅛-3⁄16 inch thick plate) to at least a portion of one or more interior surfaces of the hopper 110. For example, especially in embodiments having one or more outlets 315 angled toward the bottom 120 of hopper 110, a stainless steel plate could be attached to the inside bottom 120 of hopper 110 to help protect the fiberglass bottom 120 from undue wear caused by salt and/or dirt being agitated by liquid flow from outlets 315.

Liquid holding tank 150 is positioned proximal to the hopper 110 so that liquid in the overflow weirs 130 and 132 can flow into the tank 150. As shown, tank 150 includes a first side wall 151, a second side wall 152, a third side wall 153, a fourth side wall 154, a bottom 155, and an open top 159. As shown, a liquid outlet 157 is positioned within the fourth side wall 154. Alternatively, liquid outlet 157 could be positioned within the first side wall 151, second side wall 152, or third side wall 153. As shown in FIG. 1A, liquid holding tank 150 can optionally include a valve/opening 161 to be used as an additional clean out port and/or to be connected to a source of fresh water that can be delivered to liquid hold tank 150 to help adjust the concentration of the solute in the liquid that is present in the holding tank 150.

FIG. 1D shows a front view of the liquid holding tank 150 of the apparatus shown in FIG. 1A with the hopper 110 and pump system 199 removed. As shown in FIG. 1D, tank 150 includes three feet 162 to support tank 150 off of the ground so as to form two fork lift pockets 160 so that a fork lift can insert lifting forks into the pockets 160 and lift tank 150 if desired. Also, in the embodiment shown in FIG. 1D, the height of the sidewalls of the feet 162 decreases in a direction from first side wall 151 toward fourth side wall 154 so that as the liquid holding tank rests on a level surface, the bottom 155 is an angle so as to cause liquid to flow toward liquid outlet 157 due to gravity and facilitate cleaning out residual solids that may be present in in liquid holding tank 150 after a period of use.

As shown in FIG. 1B, the discharge side of the pump system 199 is physically coupled to the first liquid inlet 113 positioned in the hopper 110 and the liquid outlet 157 positioned in the liquid holding tank 150. The pump system 199 is configured to pump liquid from the liquid holding tank 150 into the hopper 110. As shown, pump system includes a pump 200. Pump 200 is physically coupled to motor 202 and pump 200 has an outlet (discharge) 206 and pump inlet (suction) 204. As shown in FIG. 1A, the motor 202 and pump 200 are mounted to a fiberglass grate 240 that is positioned on the side of tank 150 and anchored to the ground. Alternatively, grate 240 could be positioned on the opposite side of tank 150. Motor 202 has a power cord 241 that is connected to a power source (not shown). In some embodiments, the power source is housed in a control panel (not shown). As shown, the pump outlet 206 is connected to a conductivity sensor 208 that can determine a concentration value (e.g., of brine) as solution is recirculated from tank 150 to hopper 110. Alternatively, conductivity sensor 208 could be coupled to the suction side of pump 200. Check valve 216 is coupled to the conductivity sensor 208 and can keep liquid (e.g., brine solution) in the hopper 110 from flowing back into pump 200 and liquid holding tank 150 when pump 200 is not in operation. Connected to check valve 216 is a three-way valve 212. Valve 212 can divert liquid that is being pumped to either hopper 110 (e.g., during brine production) or to another destination (e.g., storage, a transportation truck, or the like after a target brine concentration has been reached). Connected to valve 212 is a y-strainer 214 to help mechanically remove solids from liquid. Y-strainer 212 can be connected to a destination (not shown) after a target brine concentration has been reached. Also connected to valve 212 is a hose 225 that connects valve 212 to first liquid inlet 113 in hopper 110 so that liquid can be recycled to hopper 110 from tank 150. Hose 230 connects liquid outlet 157 in tank 150 to pump inlet 204.

As shown, pump system 199 is located on the side of tank 150. Alternatively, pump system can be located at other locations depending on the power source for motor 202 and as long as liquid can properly flow from weirs 130 and 132 into tank 150.

Apparatus 100 can be operatively connected to a control system (not shown) to facilitate making a solution such as a brine solution. In some embodiments, a control system can include a control panel that houses, e.g., one or more of a main power disconnect, an emergency-stop button, manual start/stop controls, a conductivity analyzer controller (e.g., to determine brine concentration), and the like.

In some embodiments, apparatus 100 can be operated in a batch mode to make a solution. For illustration purposes, an exemplary method of making a brine solution with apparatus according to a batch mode will be described herein below.

An amount of salt can be provided in hopper 110 (e.g., to slightly below the top of hopper 110) with a front-end loader. Either before, during, or after the salt is loaded into hopper 110, an amount of fresh water can be provided in the hopper 110 via hoses 124 and 125, second liquid inlet 115, and third liquid inlet 117 from a source (not shown) external to apparatus 100 (not from the holding tank 150) so that the water can dissolve at least a portion of the salt to form a brine solution and fill the hopper to a level so that the brine solution can flow through hopper overflow weirs 130 and 132 and into liquid holding tank 150 positioned proximal to the hopper 110. An example of an external source of fresh water includes tap water. In some embodiments, tap water has salinity of less than 1000 ppm, less than 500 ppm, or even less than 200 ppm. Also, the holding tank 150 contains substantially no liquid when the hopper 110 is initially filled with water until the liquid in the hopper 110 overflows through the weirs 130 and 132 into the holding tank 150. By adding fresh water to the hopper 110 first instead of filling the holding tank 150 first and then recirculating the water into an empty hopper 110, the target brine concentration can be achieved much quicker. When there is enough brine solution in holding tank 150 (e.g., at least one-quarter to being full), the brine solution in tank 150 can be recirculated through a recirculation lines 225 and 230 from the liquid holding tank 150 into the hopper 110. In one embodiment, when the brine solution in tank 150 fills at least 5 inches deep, the brine solution in tank 150 can be recirculated through a recirculation lines 225 and 230 from the liquid holding tank 150 into the hopper 110.

When the liquid holding tank 150 is filled, the water through hose 125 can be stopped to prevent overflowing in hopper 110 or tank 150. Stopping the flow of water through 125 also stops the flow of water through hose 124. Then, the brine solution can be continuously recirculated through the recirculation lines 225 and 230 from the liquid holding tank 150 into the hopper 110 until a target concentration value of the brine solution (e.g., about 22-25%) is measured by the conductivity sensor 208 and the amount of brine in tank 150 is at a desired level. In some embodiments, the target brine concentration is 15,000 ppm or more; 20,000 ppm or more, or even 25,000 ppm or more. That is, the conductivity of the brine solution is correlated to the concentration of the brine. Additional amounts of salt can be added to hopper 110 if needed to achieve a desired concentration of the brine solution.

When a batch of brine solution having the desired concentration (i.e., target concentration) is measured by sensor 208, an alarm can notify an operator to manually shut off motor 202 and stop pump 200 or a control system (e.g., a control panel) can be electrically coupled to pump system 199 and can be configured to automatically shut off motor 202 and stop pump 200 sot that brine solution stops recirculating through the recirculation line 225 and 230.

To transfer brine solution from tank 150 to a storage tank or transportation vehicle (not shown), three-way valve 212 can be adjusted to divert brine solution from tank 150 through y-strainer 214, hose (not shown), and into the storage tank or transportation vehicle.

What is claimed is:

1. An apparatus for making a solution, the apparatus comprises:

(a) a hopper comprising:
  (i) at least one side wall;
  (ii) a bottom;
  (iii) a top;
  (iv) at least one overflow weir;
  (v) a first liquid inlet positioned within the at least one side wall; and
  (vi) at least one nozzle assembly positioned inside the lower half of the hopper and coupled to the first liquid inlet, wherein the at least one nozzle assembly comprises a manifold wherein the manifold comprises a linear array of at least three nozzles and each nozzle comprises at least three nozzle outlets directed away from the bottom of the hopper;

(b) a liquid holding tank positioned proximal to the hopper so that liquid in the overflow weir can flow into the liquid holding tank, wherein the liquid holding tank comprises:
  (i) at least one side wall;
  (ii) a bottom; and
  (iii) at least one liquid outlet positioned within the at least one side wall; and (c) a pump system physically coupled to the first liquid inlet positioned in the hopper and the at least one liquid outlet positioned in the liquid holding tank, wherein the pump system is configured to pump liquid from the liquid holding tank into the hopper.

2. The apparatus of claim 1, wherein the nozzle outlets are directed toward the top of the hopper.

3. The apparatus of claim 1, wherein the at least one nozzle assembly is positioned proximal to the bottom of the hopper and is centrally located in the side wall.

4. The apparatus of claim 1, where each nozzle is spaced at least 5 inches apart.

5. The apparatus of claim 1, wherein the hopper comprises a first side wall, a second side wall, a third side wall, and a fourth side wall, wherein the first side wall is opposite the fourth side wall and the first side wall is adjacent to and between the second side wall and the third side wall, wherein the first liquid inlet is positioned within the first side wall, wherein the hopper further comprises a second liquid inlet positioned within the second side wall and a third liquid inlet positioned within the third side wall, and wherein the second and third liquid inlets are physically coupled to a source of water via piping that is independent from the pump system.

6. The apparatus of claim 5, wherein the at least one nozzle assembly is positioned proximal to the bottom of the hopper and is centrally located in the first side wall.

7. The apparatus of claim 6, wherein the manifold comprises a linear tube coupled to at least three nozzles, wherein each nozzle comprises at least three nozzle outlets that are oriented to dispense liquid in a direction toward the top of the hopper.

8. The apparatus of claim 6, wherein adjacent nozzles are spaced apart from each other a distance in the range from 5 inches to 16 inches.

9. The apparatus of claim 1, wherein the hopper comprises two overflow weirs, each having a rectangular-shaped opening, and are positioned in the first side wall and proximal to the top of the hopper.

10. The apparatus of claim 1, wherein the pump system further comprises a conductivity sensor coupled to the suction side or the discharge side of a pump, wherein the conductivity sensor is configured to measure the concentration of a solution.

11. The apparatus of claim 1, wherein the pump system is electrically coupled to a control system that is configured to control the concentration of the solution in the liquid holding tank.

12. The apparatus of claim 1, wherein at least a portion of one or more interior surfaces of the at least one side wall and/or bottom of the hopper comprise a coating selected from the group consisting of a fluoropolymer coating, an epoxy coating, a fluorinated propylene ethylene coating, and combinations thereof.

* * * * *